US008232953B2

(12) United States Patent
Tsukio

(10) Patent No.: US 8,232,953 B2
(45) Date of Patent: Jul. 31, 2012

(54) LIQUID CRYSTAL DISPLAY DEVICE

(75) Inventor: Kouichi Tsukio, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 644 days.

(21) Appl. No.: 12/402,549

(22) Filed: Mar. 12, 2009

(65) Prior Publication Data

US 2009/0231265 A1 Sep. 17, 2009

(30) Foreign Application Priority Data

Mar. 12, 2008 (JP) ..... 2008-062371

(51) Int. Cl.
*G09G 3/36* (2006.01)

(52) U.S. Cl. ..... 345/100; 345/98; 345/204

(58) Field of Classification Search ..... 345/98, 345/99, 100, 204
See application file for complete search history.

(56) References Cited

U.S. PATENT DOCUMENTS 5,574,475 A * 11/1996 Callahan et al. ..... 345/100
5,771,031 A * 6/1998 Kinoshita et al. ..... 345/98
7,088,350 B2 * 8/2006 Miyazawa ..... 345/204
2002/0180674 A1 * 12/2002 Waterman et al. ..... 345/87
2004/0008194 A1 * 1/2004 Shigeta et al. ..... 345/204
2006/0146042 A1 * 7/2006 Ravichandran et al. ..... 345/211
2007/0030222 A1 * 2/2007 Lee et al. ..... 345/87
2007/0164883 A1 * 7/2007 Furtner ..... 341/126
2007/0279353 A1 12/2007 Oomura

FOREIGN PATENT DOCUMENTS

JP 05-181431 7/1993

* cited by examiner

*Primary Examiner* — Quan-Zhen Wang
*Assistant Examiner* — Michael J Eurice
(74) *Attorney, Agent, or Firm* — Antonelli, Terry, Stout & Kraus, LLP.

(57) ABSTRACT

A liquid crystal display device which includes a drive circuit capable of reducing electromagnetic wave noises while performing a high-definition multi-grayscale display is provided. In a liquid crystal display device, low-voltage differential signals divided into a plurality of channels are received by a receiving circuit, display data is recorded in a storage element after being arranged, and the display data is outputted to drive circuits on a liquid crystal display panel from a transmitting circuit at different frequencies. A display region of the liquid crystal display panel is divided into a plurality of divided display regions, and respective divided display regions differ from each other in the number of pixels thus making transmission clock frequencies different from each other.

16 Claims, 17 Drawing Sheets

LIQUID CRYSTAL DISPLAY DEVICE

BACKGROUND OF THE INVENTION

1. Field of the Invention

The present invention relates to a liquid crystal display device, and more particularly to a high-resolution multi-grayscale monitor and the optimum circuit constitution applicable to a control circuit which controls the high-resolution multi-grayscale monitor.

2. Description of the Related Art

A TFT (Thin Film Transistor)-type liquid crystal display device has been popularly used as a display device of a personal computer or the like. This liquid crystal display device includes a liquid crystal display panel, a drive circuit which drives the liquid crystal display panel, and a control circuit which controls the drive circuit.

In such a liquid crystal display device, the number of display data is increased along with the increase of the display resolution, and noises or the like are increased when a transmission speed of the display data becomes high. To cope with such a situation, JP-A-05-181431 discloses a technique in which display data is temporarily stored in a memory, and the display data is simultaneously transmitted to a plurality of drive circuits thus lowering a display data transmission speed.

SUMMARY OF THE INVENTION

However, even when the transmission speed is lowered by dividing a screen, due to the further increase of resolution, there arise drawbacks such as EMI (Electromagnetic Interference) again.

The present invention has been made to overcome such drawbacks of the related art and it is an object of the present invention to provide a technique relating to a liquid crystal display device which can realize a high-resolution multi-grayscale display monitor and, at the same time, can reduce a drawback such as EMI even when display data is increased.

The above-mentioned and other objects and novel features of the present invention will become apparent from the description of this specification and attached drawings.

To briefly explain the summary of typical inventions among inventions disclosed in this specification, they are as follows.

According to one aspect of the present invention, there is provided a liquid crystal display device which includes a liquid crystal display panel, a drive circuit which supplies drive signals to the liquid crystal display panel, and a control circuit which supplies display data to the drive circuit, wherein the control circuit includes a receiving circuit to which the display data is inputted from the outside, a memory element which holds the display data, and a plurality of transmitting circuits which transmits the display data held by the memory element to the liquid crystal display panel, wherein the plurality of transmitting circuits transmits the display data to display regions which differ in the number of pixels respectively. The display data which differ from each other in clock frequency are outputted from the different transmitting circuits and hence, frequencies of electromagnetic wave noises are dispersed.

To briefly explain advantageous effects acquired by the typical inventions disclosed in this specification, the liquid crystal display device can overcome drawbacks such as EMI even when the display data is increased while realizing a high-resolution multi-grayscale display monitor.

DETAILED DESCRIPTION OF THE EMBODIMENT

Hereinafter, an embodiment of the present invention is explained in detail in conjunction with drawings.

In all drawings for explaining the embodiment, parts having identical functions are given same symbols, and their repeated explanation is omitted.

Figure 1:
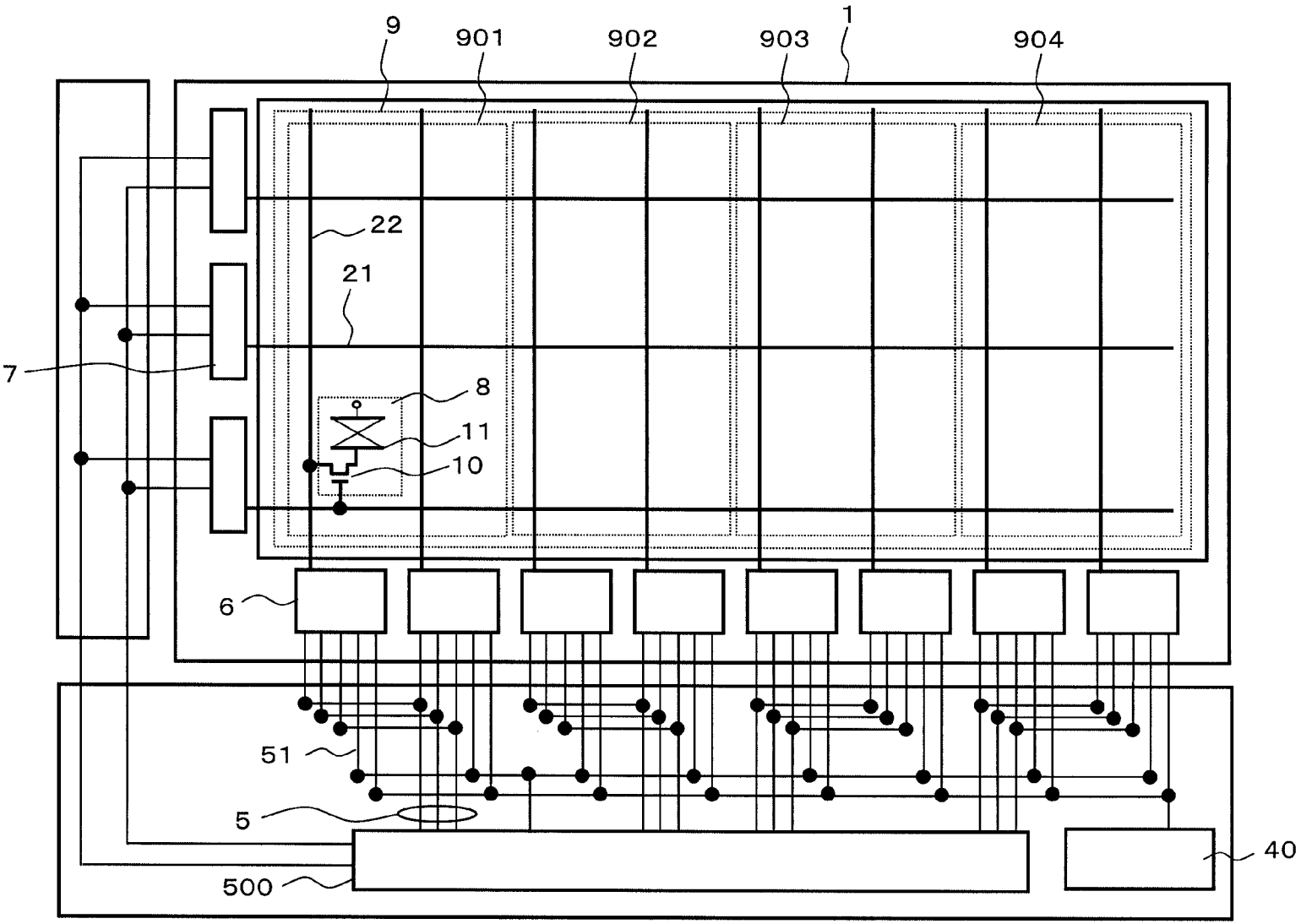
FIG. 1 is a block diagram showing the schematic constitution of a liquid crystal display device according to an embodiment of the present invention.

FIG. 1 is a block diagram showing the schematic constitution of a liquid crystal display device according to the embodiment of the present invention.

In FIG. 1, numeral 1 indicates a liquid crystal display panel, and numeral 9 indicates a display region. An image is displayed on the display region 9 in accordance with display data.

Numeral 500 indicates a controller into which the display data, control signals and the like are inputted from the outside (a computer or the like). Upon reception of the display data, the control signals or the like from the outside, the controller 500 supplies the display data, various kinds of clock signals and various control signals to the liquid crystal display panel 1.

Numeral 40 indicates a power source circuit which generates various kinds of drive voltages for driving the liquid crystal display panel 1.

Data bus lines 5 are connected to the controller 500. The controller 500 outputs the display data to the data bus lines 5. Further, the controller 500 converts the control signals inputted from the outside into signals for controlling the liquid crystal display panel 1 and outputs these signals to the liquid crystal display panel 1.

The control signals which the controller 500 outputs include timing signals such as a clock signal for allowing a source drivers 6 to fetch the display data, a clock signal for changing over an output from the source drivers 6 to the liquid crystal display panel 1, and a gate clock signal for outputting a frame start instruction signal and a sequential scanning signal for driving gate drivers 7.

Further, the power source circuit 40 generates a positive grayscale voltage, a negative grayscale voltage, a counter electrode voltage, a scanning signal voltage and the like and outputs these voltages.

The display data which is outputted from the controller 500 is transmitted or transferred to the source drivers 6 via the data bus lines 5.

The display data is constituted of digital data and, for transmission of the display data, a low-voltage differential signal is used to cope with the EMI. A serial transmission method is adopted for transmitting the low-voltage differential signals used by the data bus line 5, wherein the low-voltage differential signals are transmitted by one pair of signal lines in series such that 7 bits constitute 1 data unit for every 1 data bus line. Since the display data for each one of R, G, B is 10 bits, it is necessary to provide 5 pairs of lines as the number of data bus lines 5.

The controller 500 outputs the display data in accordance with the arrangement of pixels to the data bus lines 5. The source drivers 6 fetch data to be displayed from the display data which is sequentially outputted. Timing at which the source driver 6 fetches the display data is set in accordance with a clock signal (control signal) 51 outputted from the controller 500.

The source drivers (drive circuits) 6 are arranged along a periphery of the display region 9 in the lateral direction (X direction). Output terminals of the source drivers 6 are connected to video signal lines 22 of the liquid crystal display panel 1. The video signal lines 22 extend in the Y direction in the drawing and are connected to drain electrodes of thin film transistors 10. Further, a plurality of video signal lines 22 are arranged parallel to each other in the X direction in the drawing.

The source drivers 6 fetch the display data from the data bus lines 5, and output grayscale voltages to the video signal lines 22 in accordance with the display data. Voltages (grayscale voltages) for driving liquid crystal are supplied to the thin film transistors 10 from the video signal lines 22.

Here, although the naming of "source" and "drain" may be reversed in view of the relationship with alias, an electrode which is connected to the video signal line 22 is referred to as "drain" in this specification.

The gate drivers (scanning circuits) 7 are arranged along the periphery of the display region 9 in the longitudinal direction. Output terminals of the gate drivers 7 are connected to the scanning signal lines 21 of the liquid crystal display panel 1. The scanning signal lines 21 extend in the X direction in the drawing, and are connected to gate electrodes of the thin film transistors 10. Further, a plurality of scanning signal lines 21 is arranged in parallel to each other in the Y direction in the drawing.

The gate drivers 7 sequentially supply a scanning voltage of High level to the scanning signal lines 21 for every 1 horizontal scanning period based on a frame start instruction signal and a shift clock transmitted from the controller 3. The turn-on and the turn-off of the thin film transistors 10 are controlled in response to a scanning voltage applied to the gate electrodes of the thin film transistors 10.

The display region 9 of the liquid crystal display panel 1 has pixel portions 8 which are arranged in a matrix array. However, only one pixel portion 8 is shown in FIG. 1 for simplifying the drawing. Each pixel portion 8 includes the thin film transistor 10 and a pixel electrode 11. Each pixel portion 8 is arranged in an intersecting region where two neighboring video signal lines 22 and two neighboring scanning signal lines 21 intersect each other (a region surrounded by four signal lines).

As described previously, a scanning signal is outputted to the scanning signal lines 21 from the gate driver 7. The thin film transistor 10 is turned on and off in response to the scanning signal. The grayscale voltage is supplied to the video signal line 22 and hence, when the thin film transistor 10 is turned on, the grayscale voltage is supplied to the pixel electrode 11 from the video signal line 22. A counter electrode (common electrode; not shown in the drawing) is arranged to face the pixel electrodes 11, and a liquid crystal layer (not shown in the drawing) is provided between the pixel electrodes 11 and the counter electrode. In a circuit shown in FIG. 1, the pixel electrodes 11 and the counter electrode are shown such that a liquid crystal capacitance is connected between the pixel electrode 11 and the counter electrode equivalently. Although not shown in the drawing, an additional capacitance is provided between the pixel electrode 11 and the counter electrode.

The alignment of the liquid crystal layer is changed by applying a voltage between the pixel electrode 11 and the counter electrode. The liquid crystal display panel 1 performs a display by changing optical transmissivity of light due to a change of alignment of the liquid crystal layer.

An image displayed by the liquid crystal display panel 1 is constituted of the pixels. The grayscale of each pixel which constitutes the image conforms to a voltage supplied to the pixel electrode.

The source driver 6 receives the grayscales to be displayed as the display data and outputs the grayscale voltages corresponding to the grayscales. Accordingly, a data quantity of the display data or the number of data bus lines 5 is increased along with the increase of the number of the grayscales which the liquid crystal display panel 1 displays.

It has been known that liquid crystal is deteriorated when a DC voltage is applied to the liquid crystal for a long time. For preventing the deterioration of the liquid crystal, AC driving which periodically reverses polarity of a voltage applied to the liquid crystal layer is performed. In AC driving, a positive signal voltage and a negative signal voltage are applied to the pixel electrode with respect to the counter electrode. Accordingly, the power source circuit 40 includes a positive grayscale voltage generating circuit and a negative grayscale voltage generating circuit. The source driver 6, in response to an AC signal, selects the positive grayscale voltage or the negative grayscale voltage even when the display data is same.

The display data 9 is further divided into divided display regions 901, 902, 903, 904. The divided display regions 901, 902, 903, 904 are explained later.

Figure 2:
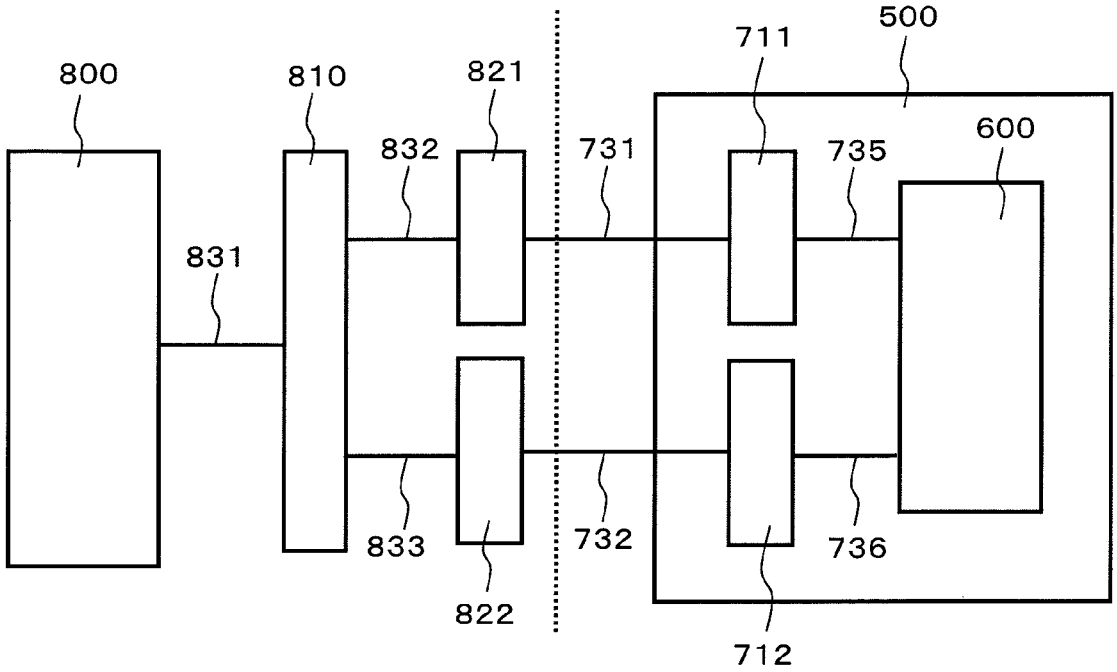
FIG. 2 is a block diagram showing the schematic constitution of an input interface of the liquid crystal display device according to the embodiment of the present invention.

Next, an input part of the controller 500 is shown in FIG. 2. In FIG. 2, numeral 800 indicates an external device such as, for example, a personal computer which can display a high-definition image. The external device 800 is connected to a dividing circuit 810 using a signal line 831. Output data is divided in two by the dividing circuit 810, and two divided output data are outputted to external transmitting circuits 821, 822 via signal lines 832, 833.

The external transmitting circuits 821, 822 convert digital signals in the external device 800 into low-voltage differential signals and, thereafter, output the low-voltage differential signals to external signal lines 731, 732. The external signal lines 731, 732 are connected to receiving circuits 711, 712 of the controller (also referred to as the control circuit) 500. Further, in FIG. 2, the receiving circuits 711, 712 are connected to a data arrangement control circuit 600 via signal lines 735, 736.

The receiving circuits 711, 712 convert the low-voltage differential signals to digital signals used in the controller 500. The low-voltage differential signals are excellent in the reduction of EMI or the like and are used in the transmission of signals between the external device 800 and the controller 500. However, a quantity of data which the external transmitting circuits 821, 822 can transmit is limited. Accordingly, in the circuit shown in FIG. 2, the data is divided in two and the divided data are transmitted to the external signal lines 731, 732. Further, the controller 500 is required to have two receiving circuits 711, 712 for receiving the data via the external signal lines 731, 732.

Figure 3:
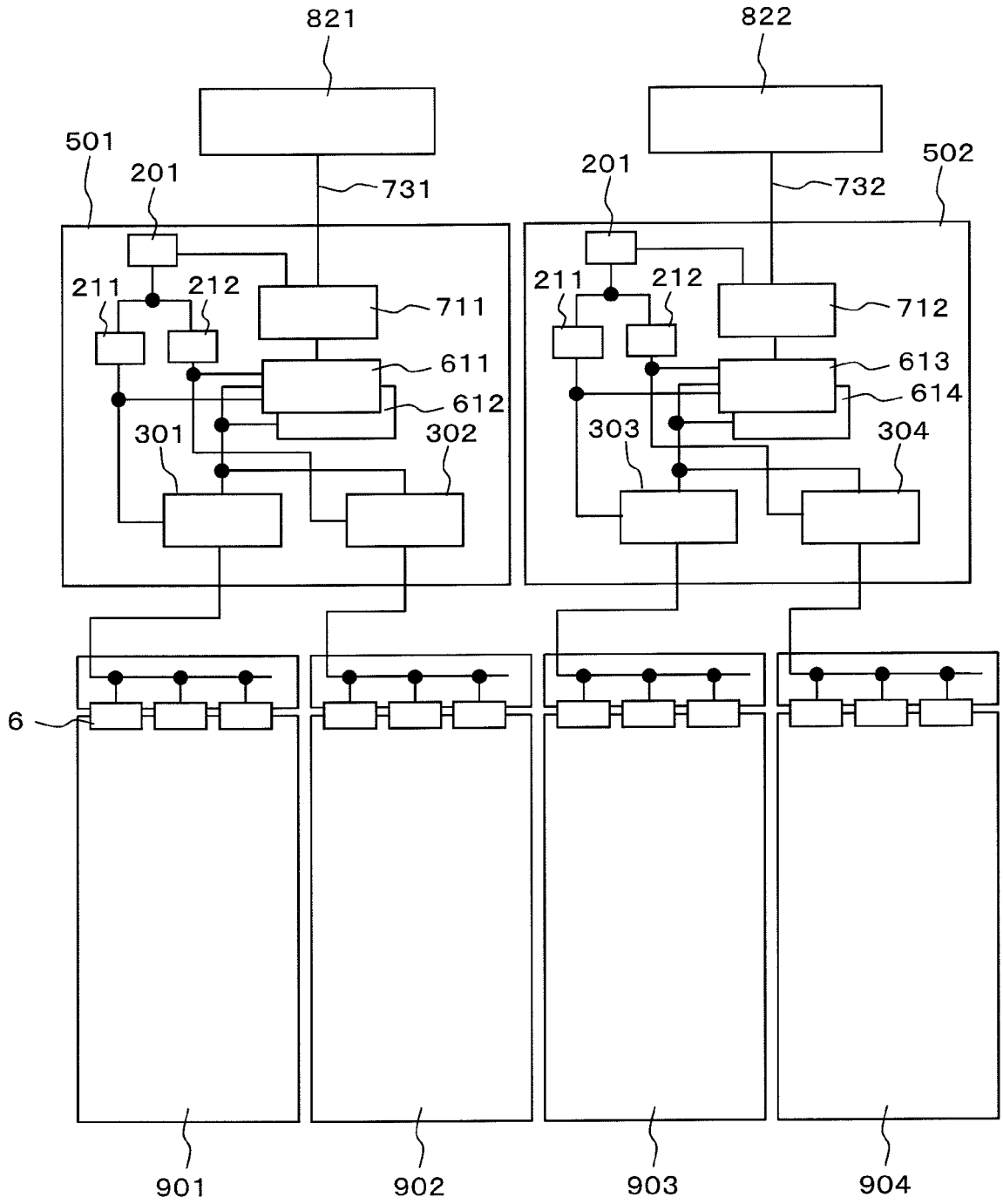
FIG. 3 is a block diagram showing the schematic constitution of the liquid crystal display device according to the embodiment of the present invention.

Next, FIG. 3 shows display data output parts 501, 502 of the controller 500 provided for outputting the display data to four divided display regions 901, 902, 903, 904.

As described previously, the low-voltage differential signals which are outputted from the external transmitting circuits 821, 822 are inputted to the receiving circuits 711, 712 via the signal lines 731, 732.

The receiving circuit 711 is connected to data recording elements 611, 612, while the receiving circuit 712 is connected to data recording elements 613, 614. The data recording elements 611, 612, 613, 614 may be, for example, constituted of a rewritable memory element or the like.

Display data corresponding to a video signal to be written in the respective display regions 901, 902 is temporarily stored in the data recording elements 611, 612, and the display data outputted from the data recording elements 611, 612 is transmitted to the source drivers 6 via internal transmitting circuits 301, 302.

In the same manner, display data corresponding to a video signal to be written in the respective display regions 903, 904 is temporarily stored in the data recording elements 613, 614, and the display data outputted from the data recording elements 613, 614 is transmitted to the source drivers 6 via internal transmitting circuits 303, 303.

Figure 4:
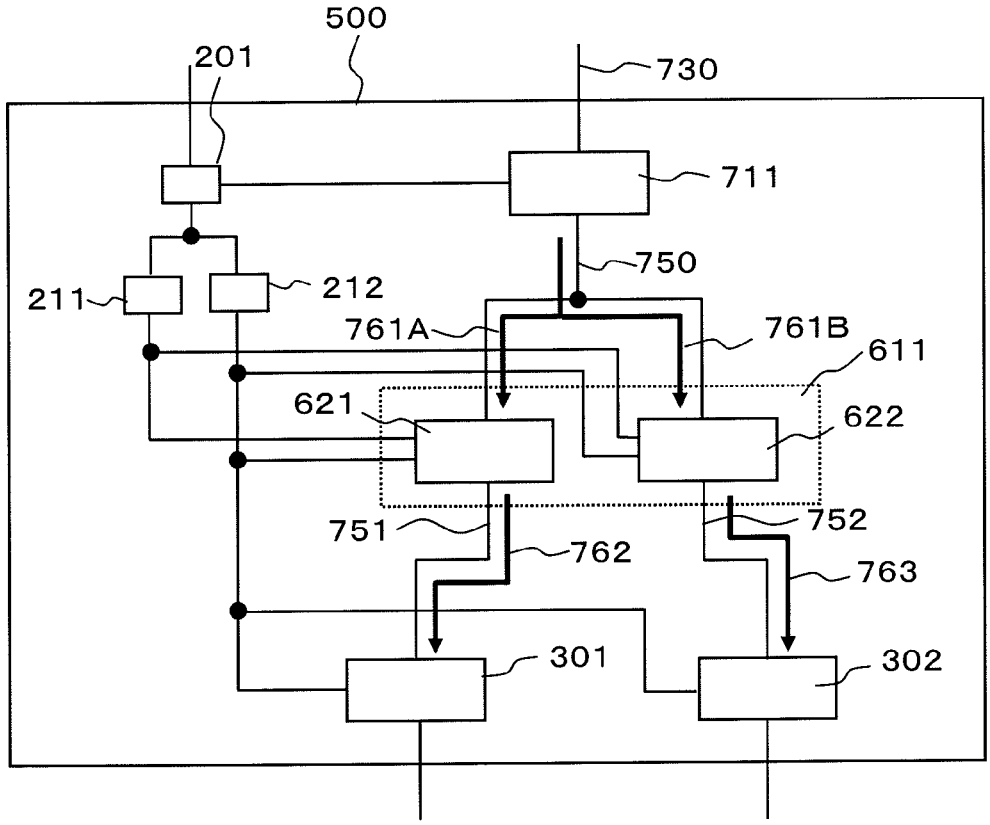
FIG. 4 is a block diagram showing the schematic constitution of one example of a controller of the liquid crystal display device according to the embodiment of the present invention.

FIG. 4 shows the transmission of display data from the receiving circuit 711 to the internal transmitting circuits 301, 302 by taking the receiving circuit 711 as a representative. The data recording element 611 is constituted of two recording elements 621, 622.

First of all, at the time of receiving the display data, the display data is written in the recording element 621 from the receiving circuit 711 as indicated by an arrow 761A via a signal line (data bus) 750. When writing of the display data in the recording element 621 is finished, the display data is written in the recording element 622 as indicated by an arrow 761B.

Next, simultaneously with such an operation, the display data is outputted to the internal transmitting circuits 301, 302 from the recording elements 621, 622 as indicated by arrows 762, 763. The recording element 621 and the internal transmitting circuit 301 are connected with each other by a signal line (data bus) 751, while the recording element 622 and the internal transmitting circuit 302 are connected with each other by a signal line (data bus) 752. That is, by transmitting the display data recorded in the recording elements 621, 622 using the different signal lines, it is possible to transmit the display data to the different internal transmitting circuits 301, 302 simultaneously.

Numerals 201, 211, 212 indicate clock control circuits. The clock control circuit 201 outputs a reference clock transmitted from an external circuit or generated by an internal circuit to the receiving circuit 711 and the clock control circuits 211, 212.

Figure 5:
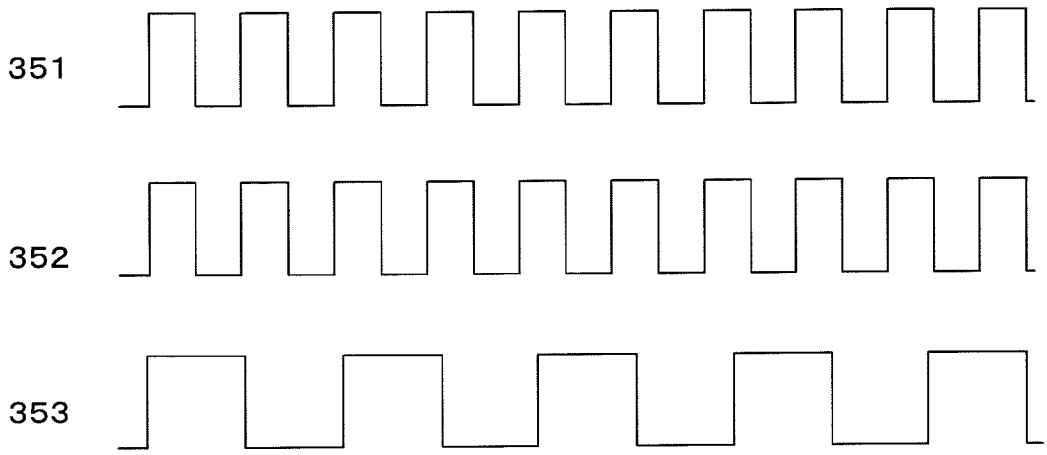
FIG. 5 is a view showing waveforms of respective clocks shown in FIG. 4.

FIG. 5 shows clock waveforms outputted from the clock control circuits 201, 211, 212. Numeral 351 shown in FIG. 5 indicates the reference clock waveform outputted from the clock control circuit 201. Numeral 352 shown in FIG. 5 indicates the clock waveform outputted from the clock control circuit 211. Further, numeral 353 shown in FIG. 5 indicates the clock waveform outputted from the clock control circuit 212. The clock waveform 351 and the clock waveform 352 are substantially equal, while the clock waveform 353 is a waveform having a frequency lower than a frequency of the clock waveform 352.

A clock is oscillated from the clock control circuit 211 at timing substantially equal to timing that the display data is received by the receiving circuit 711, and the display data is recorded in the recording elements 621, 622 at timing that the display data is received by the receiving circuit 711.

The clock 353 having a frequency lower than a frequency of the clock 352 is oscillated from the clock control circuit 212. The recording element 621 is connected to the internal transmitting circuit 301 by the signal line 751, and the recording element 622 is connected to the internal transmitting circuit 302 by the signal line 752 and hence, it is possible to transmit the display data in a state that the display data is divided in two whereby the display data can be transmitted through the signal lines 751, 752 at timing slower than timing that the display data is transmitted through the signal line 750.

Figure 6:
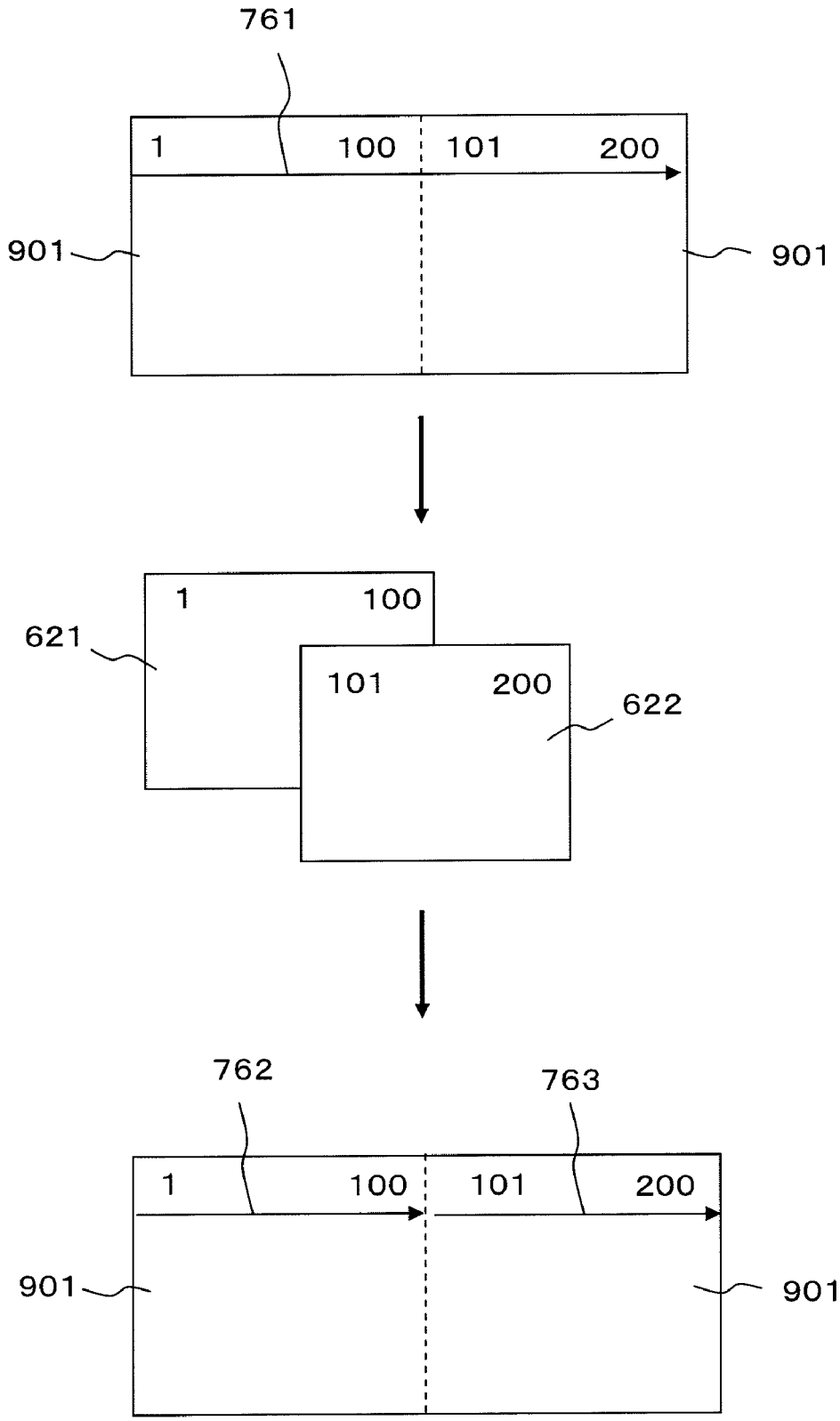
FIG. 6 is a view for explaining the transmission of display data of the liquid crystal display device according to the embodiment of the present invention.
Figure 7:
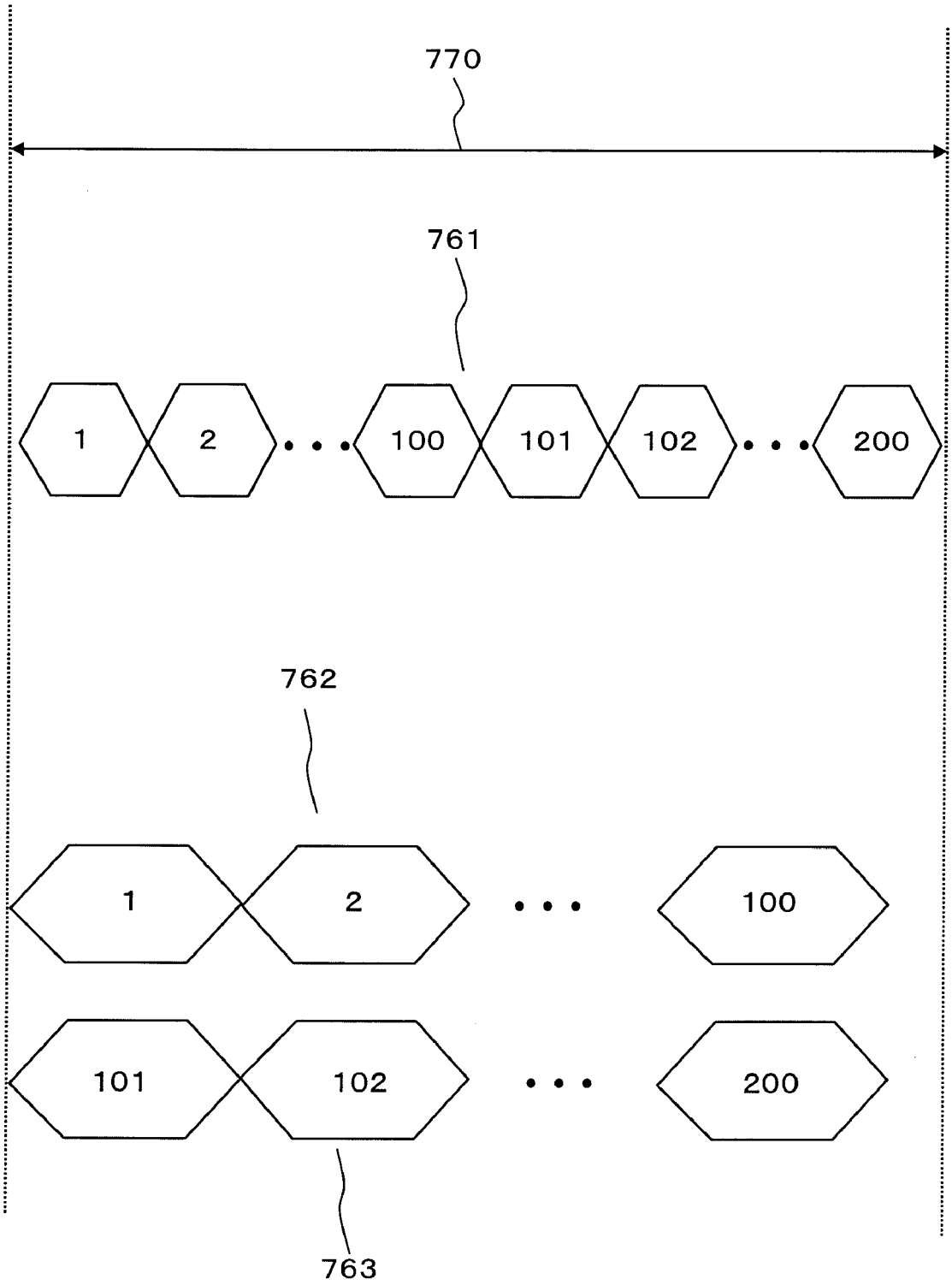
FIG. 7 is a view for explaining the transmission of display data of the liquid crystal display device according to the embodiment of the present invention.

FIG. 6 and FIG. 7 show modes in which the display data is transmitted. FIG. 6 shows the mode in which 200 pieces of display data are arranged and displayed in a row in the display regions 901, 902 respectively. Assume that the 1st to 100th display data are arranged in the display region 901, and the 101st to 200th display data are arranged in the display region 902.

FIG. 7 shows that the transmission indicated by the arrow 761 shown in FIG. 4 and the transmissions indicated by the arrows 762, 763 are performed within the 1 reference period 770. The display data is transmitted from the receiving circuit 711 in order as indicated by the arrow 761, that is, from the 1st display data to 100th display data and, then, from the 101st display data to the 200th display data, wherein the 1st display data to the 100th display data are recorded in the recording element 621 and the 101st display data to the 200th display data are recorded in the recording element 622.

The above-mentioned transmissions are performed repeatedly for every 1 reference period 770. After the display data is recorded in the recording elements 621, 622, within the next reference period 770, the 1st to the 100th display data are transmitted to the internal transmitting circuit 301 from the recording element 621 and the 101st to the 200th display data are transmitted to the internal transmitting circuit 302 from the recording element 622.

The controller 500 includes the data recording elements 611, 612, wherein when the display data is being written in the data recording element 611, the display data is transmitted to the internal transmitting circuits 301, 302 from the data recording element 612, while when the display data is being transmitted to the internal transmitting circuits 301, 302 from the data recording element 611, the display data is written in the data recording element 612.

In this manner, the controller 500 includes the data recording elements 611, 612 for performing writing and reading separately, each data recording element 611, 612 includes the recording elements 621, 622 and the internal transmitting circuits 301, 302, and each data recording element 611, 612 further includes the different signal lines 751, 752. Due to such constitution, the controller 500 can output the display data inputted from one receiving circuit to two display regions at a transmission speed different from a transmission speed at the time of receiving the display data.

Here, when the recording elements 621, 622 and the internal transmitting circuits 301, 302 are connected using the same signal line, it is impossible to transmit the different display data to the different display regions 901, 902 simultaneously.

Figure 8:
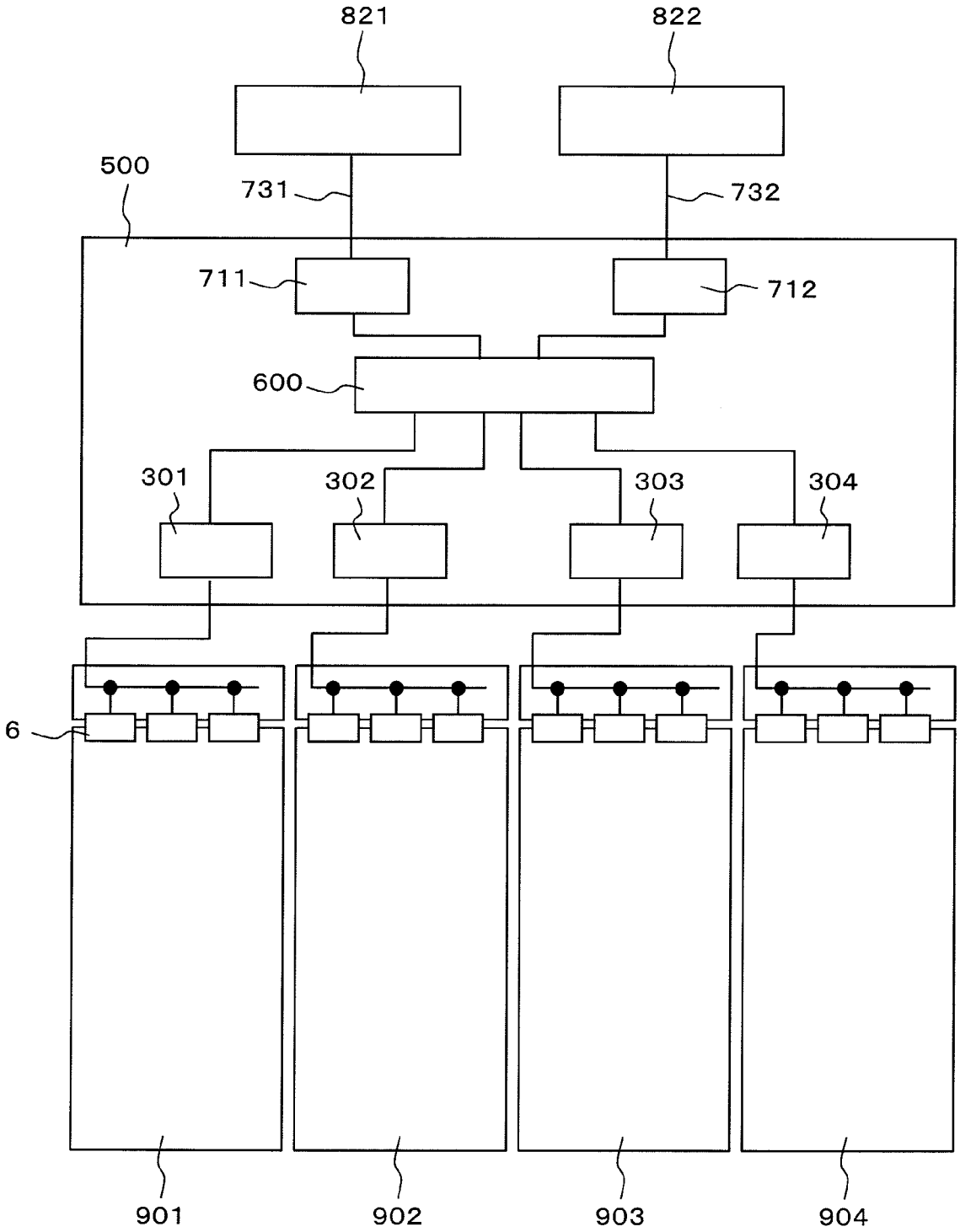
FIG. 8 is a block diagram showing the schematic constitution of a liquid crystal display device according to a modification of the embodiment of the present invention.

Next, FIG. 8 shows a controller 500 provided with a data arrangement control circuit 600. The data arrangement control circuit 600 records display data received by receiving circuits 711, 712, changes the order of the transmission of the display data when necessary, and outputs the display data to the internal transmitting circuits 301, 302, 303, 304.

Figure 9:
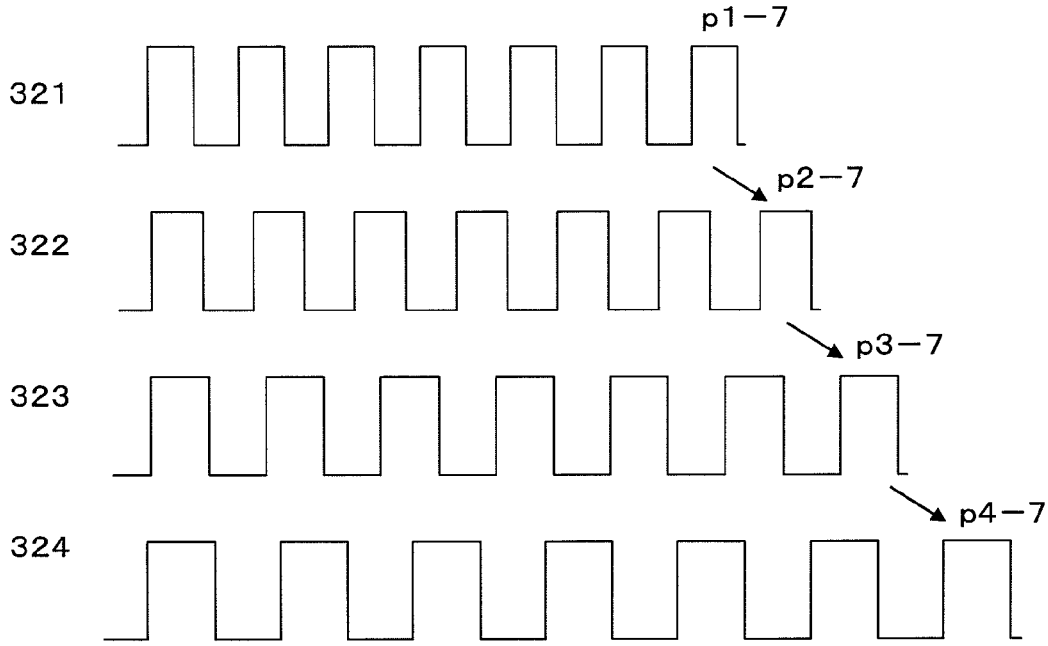
FIG. 9 is a view showing one example of waveforms of display data outputted from a data arrangement control circuit shown in FIG. 8.

Next, FIG. 9 shows output waveforms of display data outputted from the data arrangement control circuit 600. Numeral 321 shown in FIG. 9 indicates the output waveform of the display data outputted to the internal transmitting circuit 301, numeral 322 shown in FIG. 9 indicates the waveform of the display data outputted to the internal transmitting circuit 302, numeral 323 shown in FIG. 9 indicates the waveform of the display data outputted to the internal transmitting circuit 303, and numeral 324 shown in FIG. 9 indicates the waveform of the display data outputted to the internal transmitting circuit 304.

In FIG. 9, wavelengths of the respective waveforms 321, 322, 323, 324 are changed. By changing the wavelengths of the respective signals, frequencies are changed for the respective signals whereby frequencies of generated electromagnetic wave noises are also dispersed thus averaging the electromagnetic wave noises leading to lowering of peak values.

However, when the frequencies of the signals are changed, the difference arises among times necessary for transmitting the same number of display data thus giving rise to a drawback that when the transmission of the display data is started simultaneously, the respective display data differ in transmission completion time. Although the waveforms of the display data up to seventh pulse are shown in FIG. 9, all pulses p1-7, p2-7, p3-7, p4-7 have falling times thereof shifted from each other.

Figure 10:
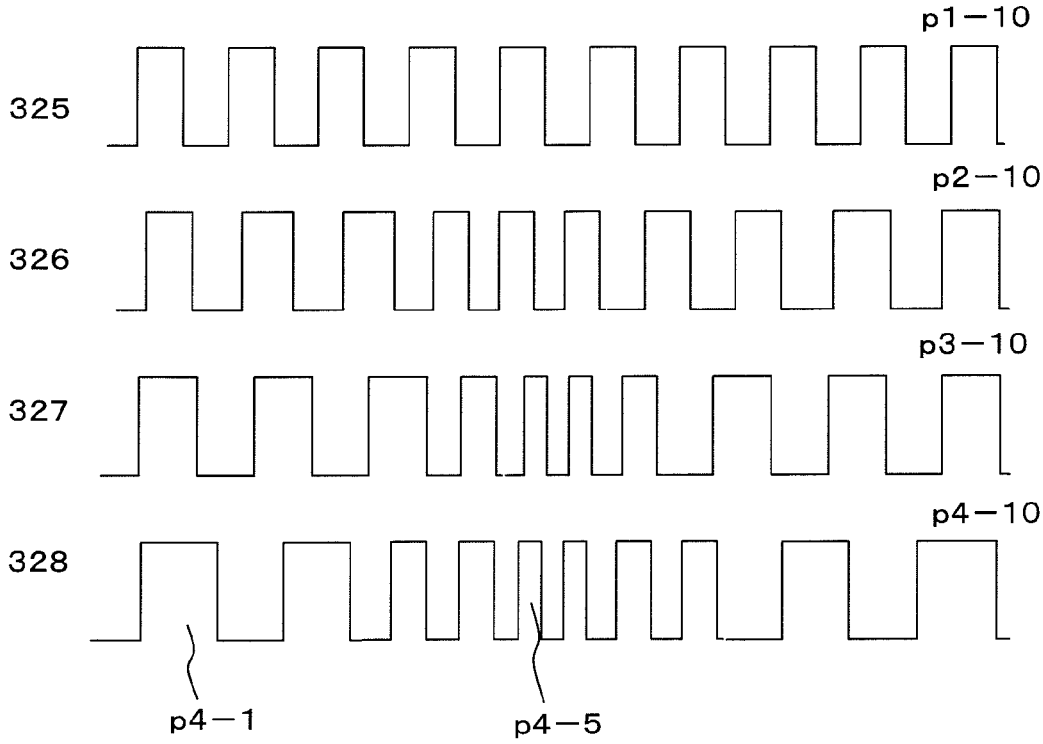
FIG. 10 is a view showing another example of waveforms of display data outputted from a data arrangement control circuit shown in FIG. 8.

FIG. 10 shows waveforms of the respective display data in which wavelengths of the waveforms outputted from the data arrangement control circuit 600 are expanded or contracted within a fixed period. Among the display data outputted from the data arrangement control circuit 600, numeral 325 shown in FIG. 10 indicates the waveform of the display data outputted to the internal transmitting circuit 301, numeral 326 shown in FIG. 10 indicates the waveform of the display data outputted to the internal transmitting circuit 302, numeral 327 shown in FIG. 10 indicates the waveform of the display data outputted to the internal transmitting circuit 303, and numeral 328 shown in FIG. 10 indicates the waveform of the display data outputted to the internal transmitting circuit 304.

In the display data 328, although a wavelength of the pulse p4-5 is set shorter than a wavelength of the pulse p4-1, an ensuing pulse p4-10 has a wavelength substantially equal to the wavelength of the pulse p4-1. With respect to the display data 325, 326, 327, 328, although wavelengths of these display data are changed within a fixed period respectively, 10th pulse falls at the same timing.

As shown in FIG. 10, by changing frequency, it is possible to suppress a peak attributed to frequencies of electromagnetic wave noises and, at the same time, it is also possible to finish pulses at substantially same timing.

Figure 11:
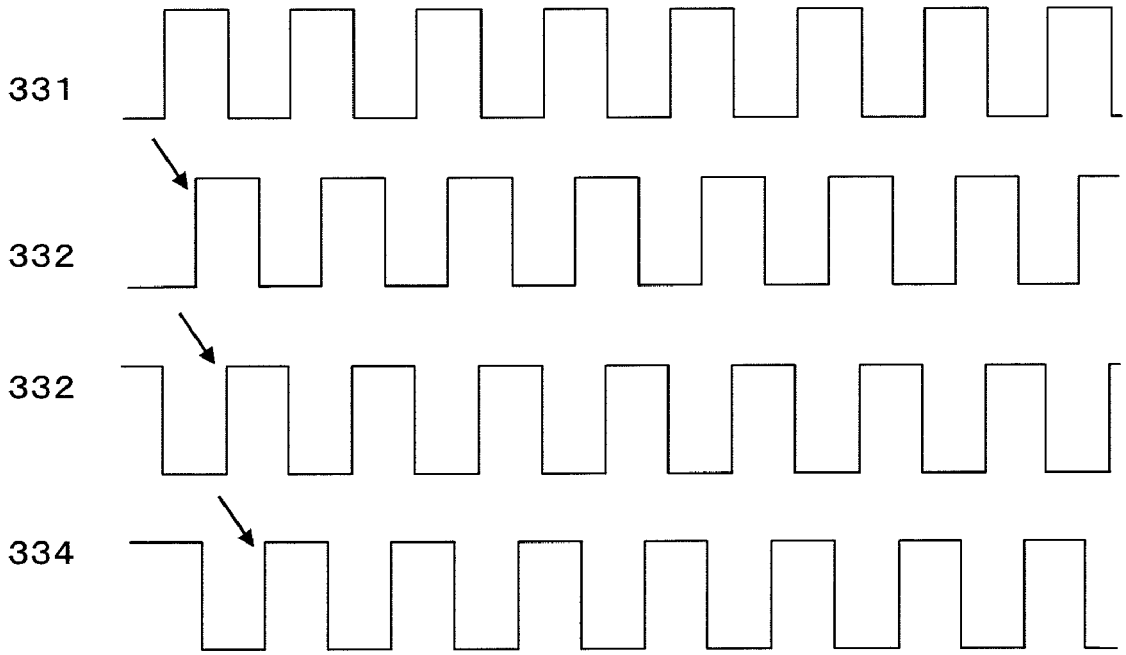
FIG. 11 is a view showing another example of waveforms of display data outputted from a data arrangement control circuit shown in FIG. 8.

Next, FIG. 11 shows waveforms of display data when phases of respective pulses are shifted for every 45°. By adopting waveforms shown in FIG. 11, it is possible to suppress a peak for every frequency of electromagnetic wave noises and, at the same time, the pulses can be completed with the shift which falls within 1 pulse.

Although the method which reduces the electromagnetic wave noises using the data arrangement control circuit 600 has been explained, it is also possible to adopt a method which reduces electromagnetic wave noises in the same manner using the display data output parts 501, 502 of the controller 500 shown in FIG. 3.

Figure 12:
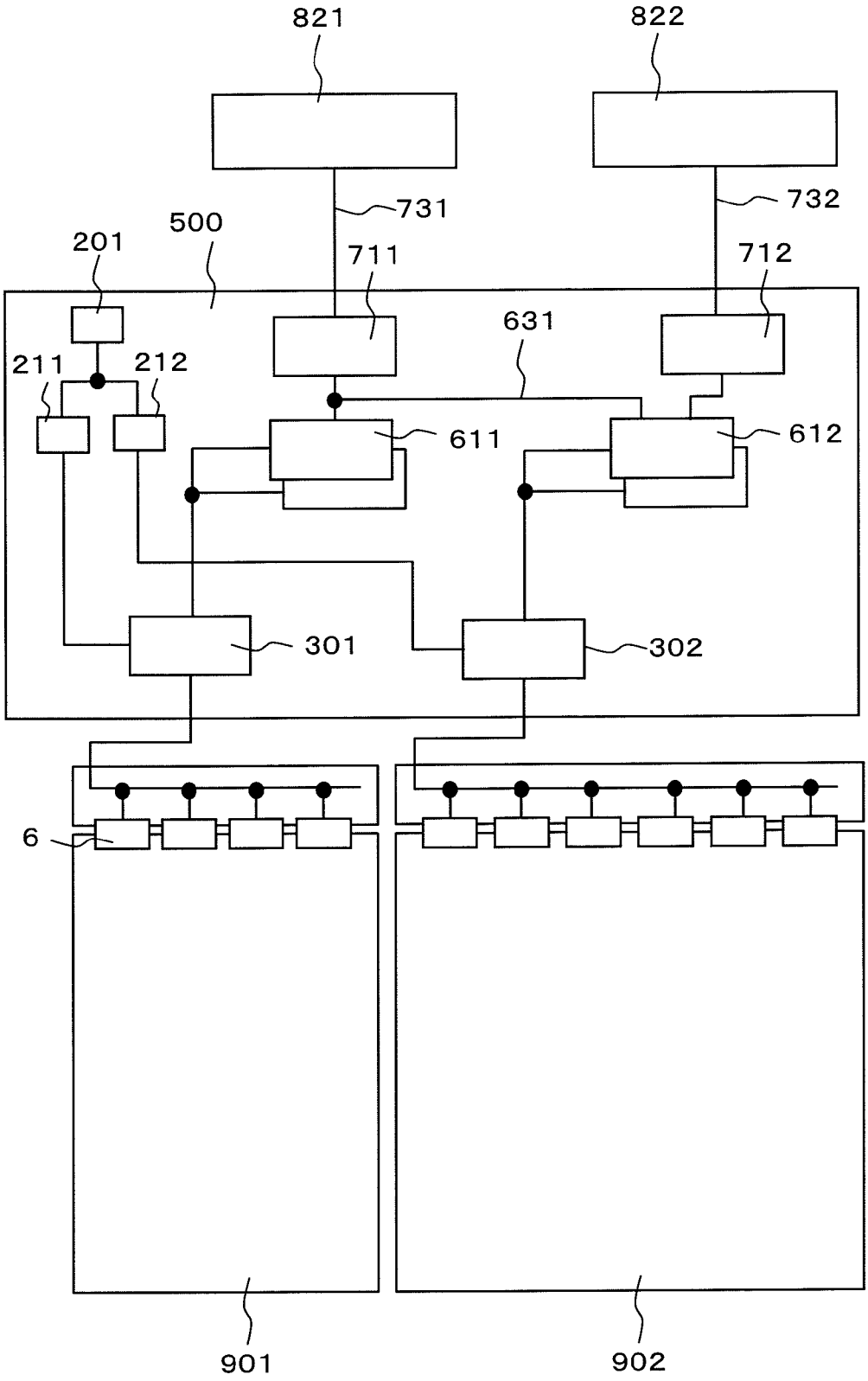
FIG. 12 is a block diagram showing the schematic constitution of another example of a controller of the liquid crystal display device according to the embodiment of the present invention.

Next, FIG. 12 shows a case in which the number of pixels arranged in a row differs between display regions 901, 902. For example, by allowing the display region 901 to have the number of pixels which conforms to an existing standard and by allowing the display region 902 to have the number of pixels which does not conform to the standard in FIG. 12, the display region 901 side can make use of the circuit constitution of an existing controller 500.

Figure 13:
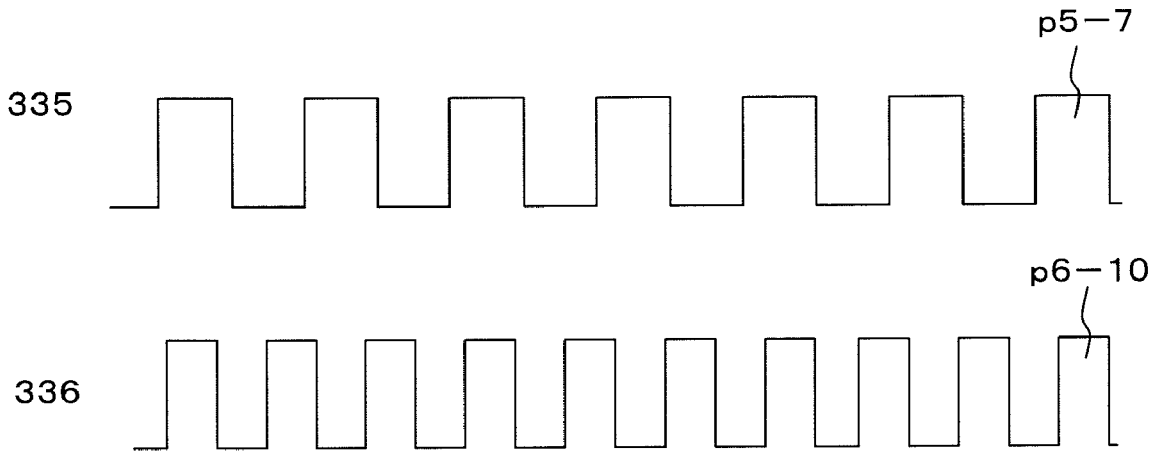
FIG. 13 is a view showing one example of waveforms of display data outputted from an internal transmitting circuit shown in FIG. 12.

Output waveforms of the internal transmitting circuits 301, 302 when the display regions 901, 902 shown in FIG. 12 are driven are shown in FIG. 13. In FIG. 13, numeral 335 indicates the waveform outputted to the display region 901, and numeral 336 indicates the waveform outputted to the display region 902.

For example, assuming that the number of pixels arranged in the display region 901 as 7 and the number of pixels arranged in the display region 902 as 10, to finish outputting of the display data simultaneously, it is necessary to set a wavelength of the pulse outputted to the display region 901 larger than a wavelength of the pulse outputted to the display region 902.

As shown in FIG. 13, by making the wavelength of the display data different between the display regions 901, 902, frequencies of the display data are dispersed thus giving rise to an advantageous effect that electromagnetic wave noises are reduced. However, when the number of pixels differs between the display regions 901, 902 and the two-divided display data are transmitted to the receiving circuits 711, 712, it is necessary to transmit the display data to a data recording element 612 having the large number of pixels from a data recording element 611 having the small number of pixels via the signal line 631. Further, for alternately performing writing and reading of the display data, the data recording elements 611, 612 are required to have a plurality of recording elements.

Figure 14:
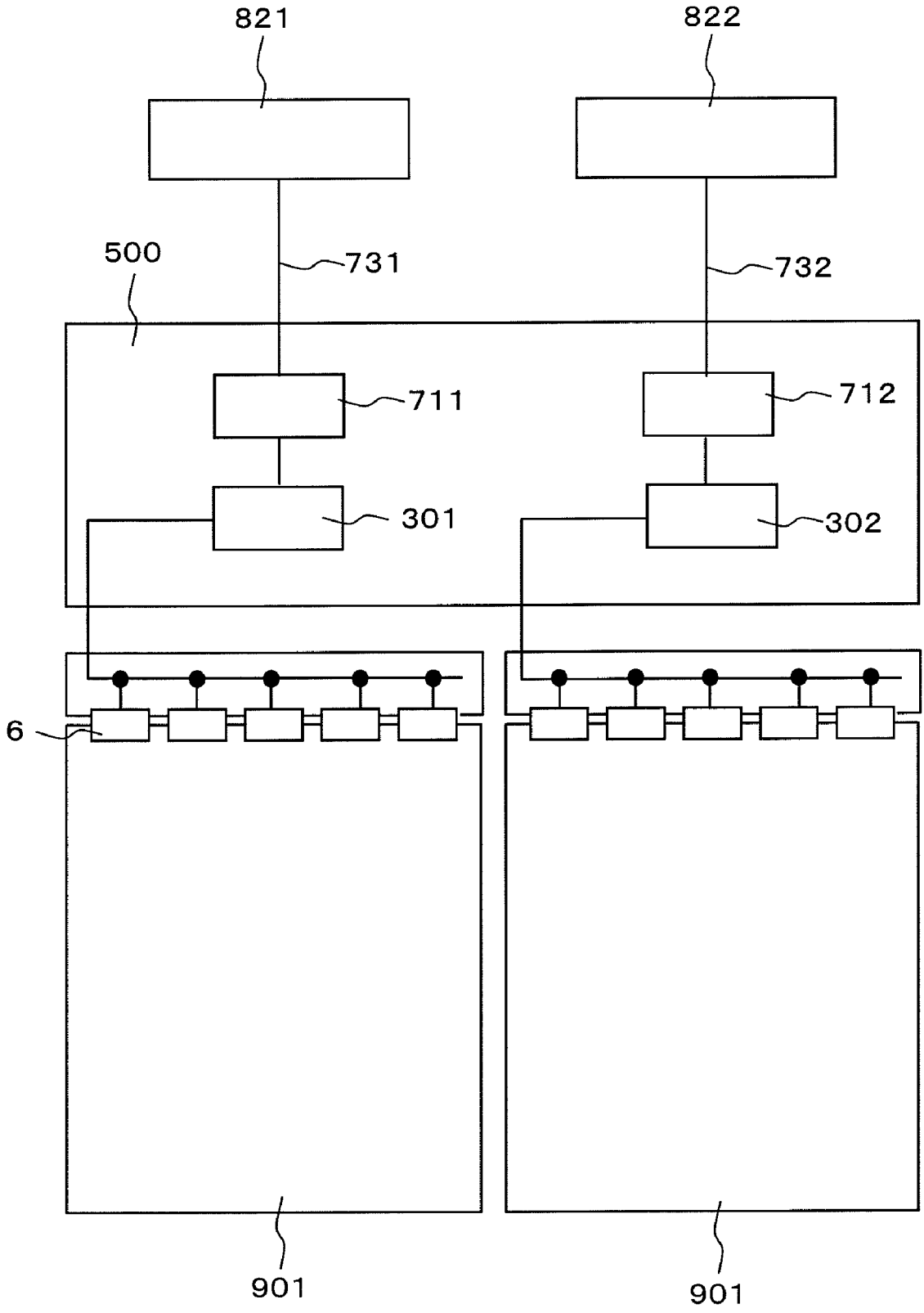
FIG. 14 is a block diagram showing the schematic constitution of another example of a controller of the liquid crystal display device according to the embodiment of the present invention.

Next, FIG. 14 shows a case in which the number of pixels in the display region 901 and the number of pixels in the display region 902 are equal. In this case, both of display regions 901, 902 constitute a display region which does not conform to the standard and hence, a source driver 6 is required to prepare a large number of dummy output circuits whereby the number of drive circuits is increased thus increasing a manufacturing cost.

Figure 15:
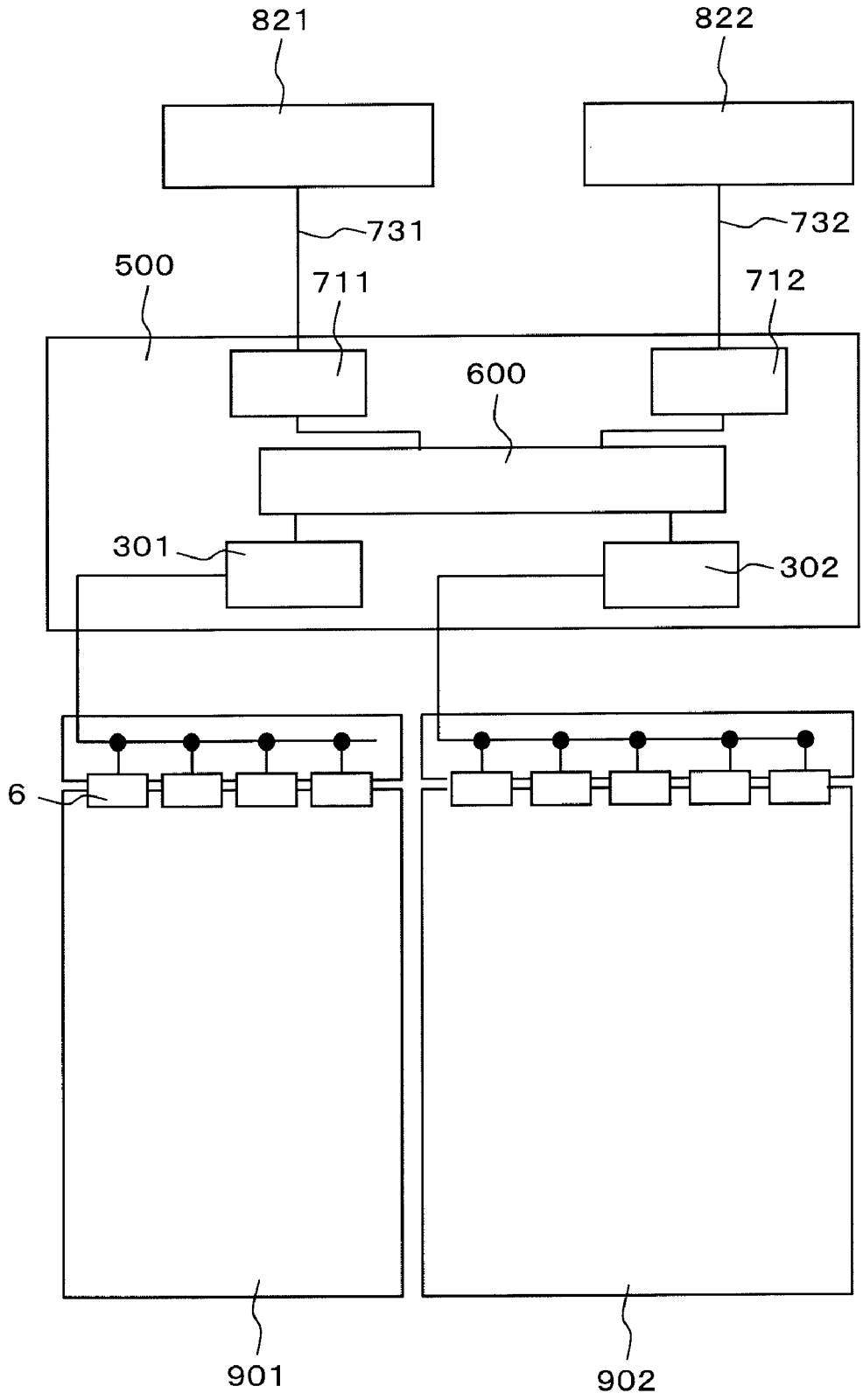
FIG. 15 is a block diagram showing the schematic constitution of another example of a controller of the liquid crystal display device according to the embodiment of the present invention.

FIG. 15 shows a case in which a data arrangement control circuit 600 is provided in a state that the number of pixels is different between the display regions 901, 902. The data arrangement control circuit 600 rearranges and transmits the display data received by the receiving circuits 711, 712 such that the display data can be outputted to the respective internal transmitting circuits.

Figure 16:
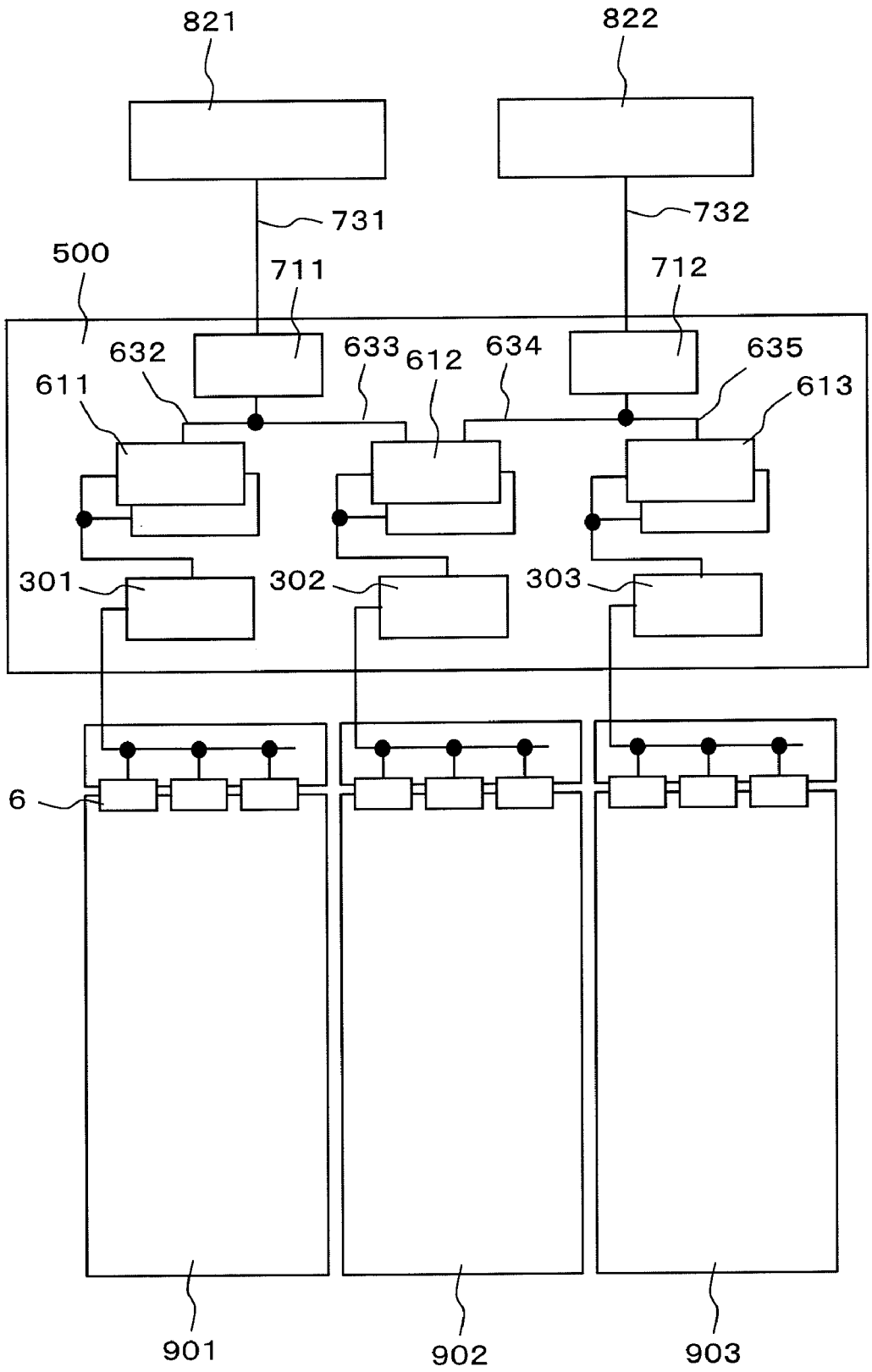
FIG. 16 is a block diagram showing the schematic constitution of another example of a controller of the liquid crystal display device according to the embodiment of the present invention.

Next, FIG. 16 shows a case in which a display region 9 is divided in three, that is, into display regions 901, 902, 903. Display data corresponding to 1 row is inputted to the receiving circuits 711, 712 in two-divided manner. The inputted display data is rearranged among the data recording elements 611, 612, 613, and the display data is outputted to internal transmitting circuits 301, 302, 303 in a 3-divided manner.

Figure 17:
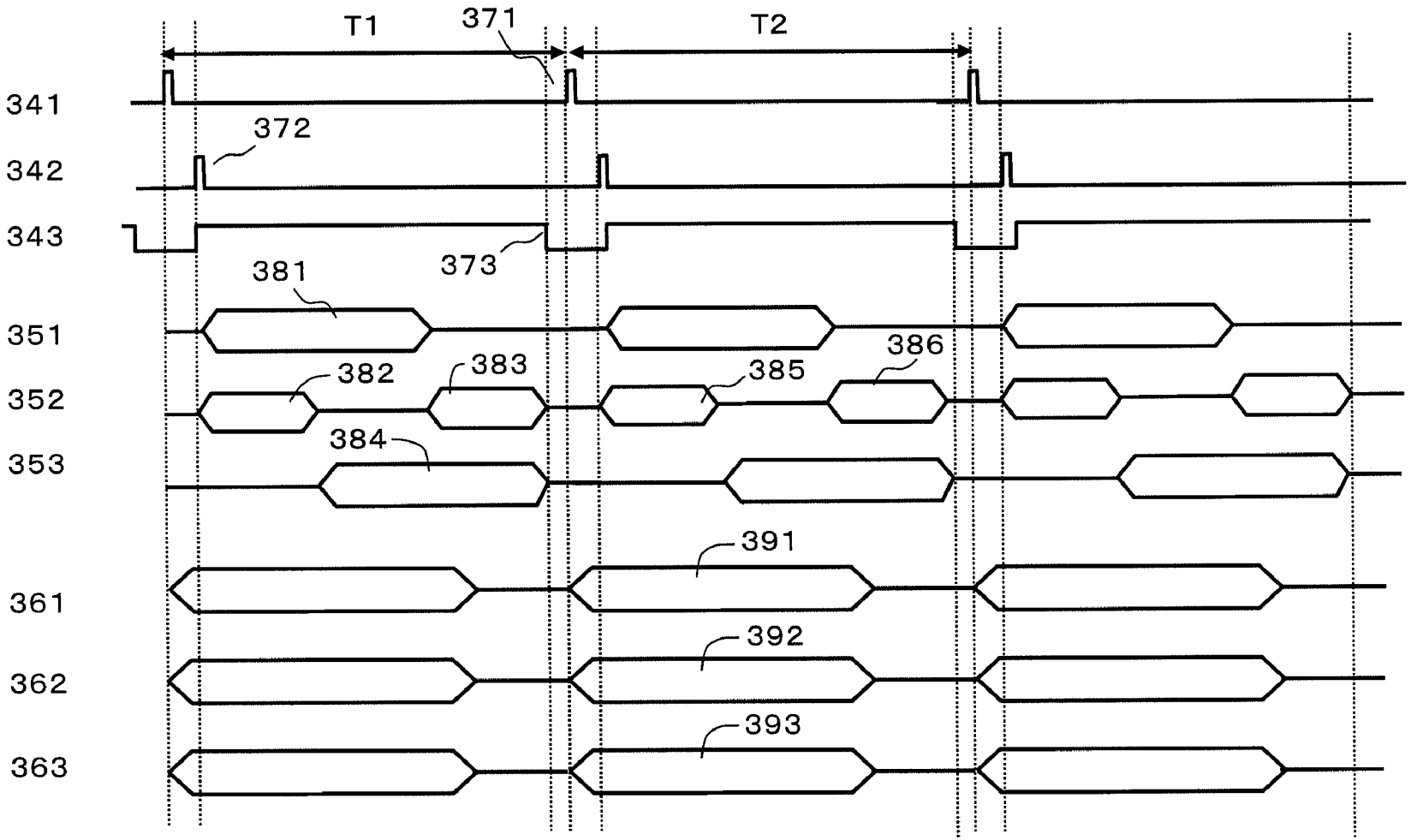
FIG. 17 is a view for explaining the rearrangement of display data in the controller shown in FIG. 16.

FIG. 17 is a timing chart showing a mode in which the display data is rearranged. A waveform 341 shown in FIG. 17 indicates an output start signal, and the display data is outputted to the internal transmitting circuits 301, 302 from the data recording elements 611, 612, 613 at timing that a pulse 371 rises.

Further, a waveform 342 shown in FIG. 17 indicates an input start signal, and writing of the display data in the data recording elements 611, 612, 613 is started at timing that a pulse 372 rises. Further, a waveform 343 shown in FIG. 17 indicates an input completion signal. That is, the waveform 343 indicates the completion of writing of the display data to the data recording elements 611, 612, 613.

A waveform 351 shown in FIG. 17 indicates a mode in which the display data is written in the data recording element 611, a waveform 352 shown in FIG. 17 indicates a mode in which the display data is written in the data recording element 612, and a waveform 353 shown in FIG. 17 indicates a mode in which the display data is written in the data recording element 613.

Further, a waveform 361 shown in FIG. 17 indicates a mode in which the display data is transmitted to the internal transmitting circuit 301 from the data recording element 611, a waveform 362 shown in FIG. 17 indicates a mode in which the display data is transmitted to the internal transmitting circuit 302 from the data recording element 612, and a waveform 363 shown in FIG. 17 indicates a mode in which the display data is transmitted to the internal transmitting circuit 303 from the data recording element 613.

First of all, during a period T1, at timing that the pulse 372 rises, the display data indicated by the waveform 351 is written in the data recording element 611 from the receiving circuit 711 via a signal line 632. Simultaneously with such an operation, the display data 382 is written in the data recording element 612 from the receiving circuit 712 via a signal line 634.

Next, when writing of the display data 381 corresponding to the display region 901 in the data recording element 611 is completed, as ensuing processing, the display data 383 corresponding to the display region 902 is written in the data recording element 612 via a signal line 633.

Further, when writing of the display data 382 corresponding to the display region 902 in the data recording element 612 is completed, the display data 384 is written in the data recording element 613 from the receiving circuit 712 via the signal line 634.

Next, in a period T2, when the pulse 371 rises, the display data 391 is outputted to the internal transmitting circuit 302 from the data recording element 611, the display data 392 is outputted to the internal transmitting circuit 302 from the data recording element 612, and the display data 393 is outputted to the internal transmitting circuit 303 from the data recording element 613.

The display data 391 is the display data 381 recorded in the data recording element 611 during the period T1. The display data 392 is data which is obtained by combining the display data 382 recorded in the data recording element 612 and the display data 383 recorded in the data recording element 611. The order of the display data 383 and the display data 382 is arranged, wherein the display data 383 is outputted first and the display data 382 is outputted thereafter thus forming the display data 392. The display data 393 is the display data 384 recorded in the data recording element 613.

To output the inputted display data to three display regions 901, 902, 903 using two receiving circuits 711, 712, as in the case of the circuit shown in FIG. 16, it is necessary to rearrange the display data.

Figure 18:
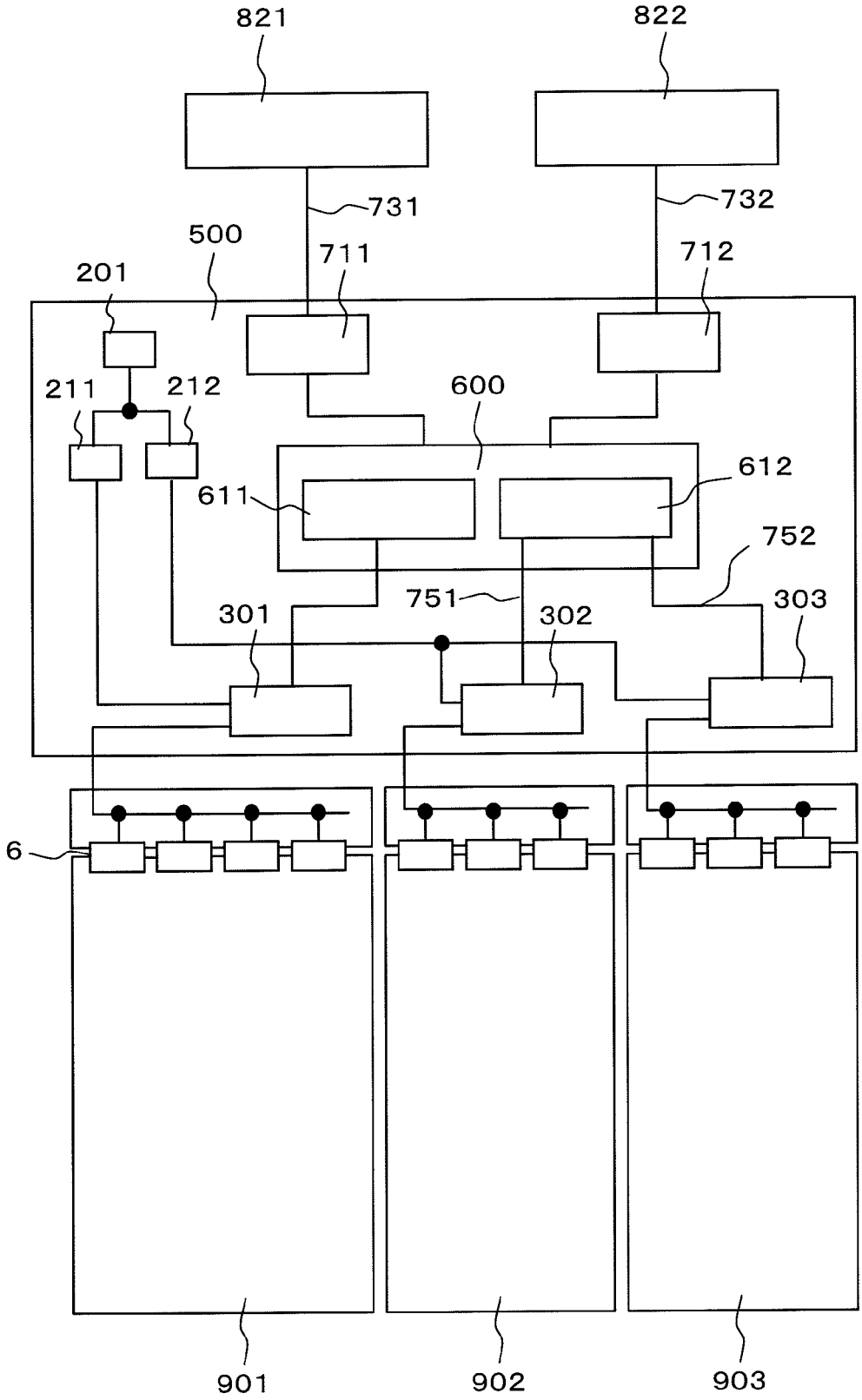
FIG. 18 is a block diagram showing the schematic constitution of another example of a controller of the liquid crystal display device according to the embodiment of the present invention.

FIG. 18 shows a case in which the number of pixels arranged in 1 row in the display region 901 is larger than the number of pixels arranged in 1 row in the display region 902 or the display region 903. In FIG. 18, the order of the display data is arranged using the data arrangement control circuit 600.

Figure 19:
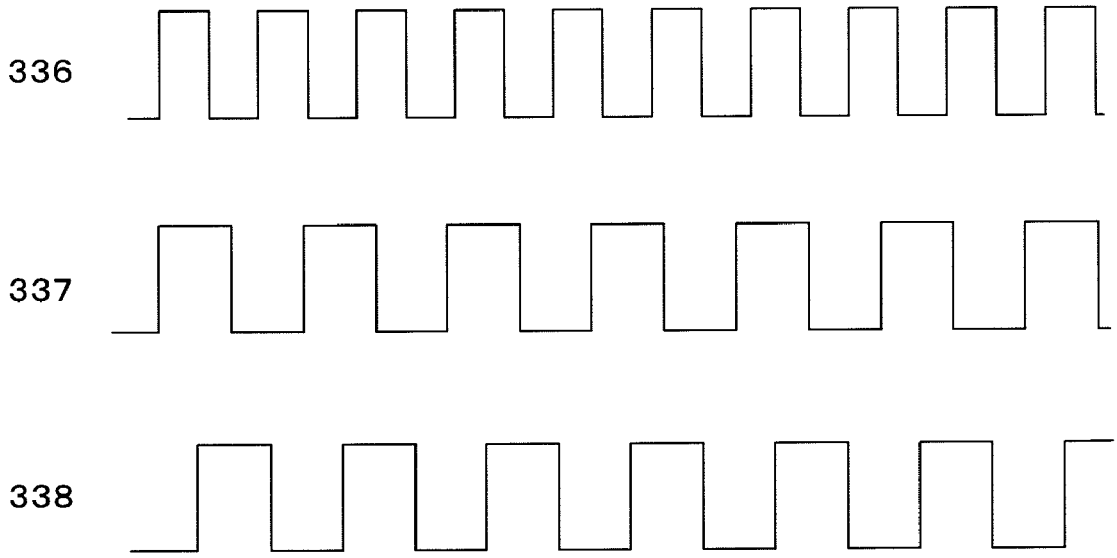
FIG. 19 is a view showing waveforms of clocks for outputting display data from an internal transmitting circuit shown in FIG. 18.

FIG. 19 shows clock waveforms when the number of pixels in the display region 901 is large. Numeral 336 in FIG. 19 shows the clock waveform which becomes the reference at the time of transmitting display data to the display region 901 from the internal transmitting circuit 301. The clock waveform 337 is the reference clock which is used in the transmission of display data to the display region 902 from the internal transmitting circuit 302, and the clock waveform 338 is the reference clock which is used in the transmission of display data to the display region 903 from the internal transmitting circuit 303. A frequency of the clock waveform 336 is set higher than frequencies of the clock waveforms 337, 338. Further, a phase of the clock waveform 337 outputted to the display region 902 and a phase of the clock waveform 338 outputted to the display region 903 are shifted from each other and hence, clock frequencies are dispersed thus reducing electromagnetic wave noises.

As has been explained heretofore, according to the embodiment of the present invention, it is possible to reduce electromagnetic wave noises of the liquid crystal display device by dispersing frequencies of the transmitting clocks of the display data to be transmitted to the liquid crystal display panel.

Although the invention made by inventors of the present invention has been specifically explained based on the embodiment, it is needless to say that the present invention is not limited to such an embodiment, and various modifications can be made without departing from the gist of the present invention.

What is claimed is:

1. A liquid crystal display device comprising:

a liquid crystal display panel including at least first and second display regions;

a plurality of drive circuits which drives the liquid crystal display panel; and a control circuit coupled between an external device and the drive circuits and which is configured to supply digital display data from the external device to the drive circuits, wherein:

the control circuit includes:

an input part to which display data is inputted from the external device;

a data holding part which holds display data;

first and second transmitting parts which transmit the display data held by the data holding part to one or more of the drive circuits coupled to the liquid crystal display panel, and the input part electrically connects the first transmitting part and the second transmitting part, the first transmitting part outputs the display data to one or more of the drive circuits coupled to the first display region, the second transmitting part outputs the display data to one or more of the drive circuits coupled to the second display region, and a number of pixels arranged in a row differs between the first display region and the second display region.

2. The liquid crystal display device according to claim 1, wherein a clock frequency with which the display data is read in the data holding part from the input part and a clock frequency with which the display data is read out to the transmitting part from the data holding part differ from each other.

3. The liquid crystal display device according to claim 1, wherein the display data inputted to the input part is a low-voltage differential signal.

4. The liquid crystal display device according to claim 1, wherein the number of input part is an even number and the number of transmitting part is an odd number.

5. The liquid crystal display device according to claim 1, wherein a transmitting clock frequency of the display data outputted from the first transmitting circuit and a transmitting clock frequency of the display data outputted from the second transmitting circuit differ from each other.

6. A liquid crystal display device comprising:

a liquid crystal display panel including at least first and second display regions;

a plurality of drive circuits which drives the liquid crystal display panel; and a control circuit coupled between an external device and the drive circuits and which is configured to supply digital display data from the external device to the drive circuits, wherein the control circuit includes:

a receiving circuit to which display data is inputted from the external device;

a memory element which stores the display data; and a first transmitting circuit and a second transmitting circuit which transmit the display data stored in the memory element to one or more of the drive circuits coupled to the liquid crystal display panel, wherein the first transmitting part outputs the display data to one or more of the drive circuits coupled to the first display region, wherein the second transmitting part outputs the display data to one or more of the drive circuits coupled to the second display region, a number of pixels arranged in a row differs between the first display region and the second display region, and the number of display data which the first transmitting circuit transmits within a definite output period and the number of display data which the second transmitting circuit transmits within the definite output period differ from each other.

7. A liquid crystal display device according to claim 6, wherein a clock frequency with which the display data is read in the memory element from the receiving circuit and a clock frequency with which the display data is read out to the first and second transmitting circuits from the memory element differ from each other.

8. The liquid crystal display device according to claim 6, wherein the display data inputted to the input circuit is a low-voltage differential signal.

9. The liquid crystal display device according to claim 6, wherein the memory element includes a first memory element and a second memory element, the first memory element and the first transmitting circuit are connected with each other by a first data bus, and the second memory element and the second transmitting circuit are connected with each other by a second data bus.

10. The liquid crystal display device according to claim 6, wherein a clock frequency with which the display data is transmitted to the first display region from the first transmitting circuit and a clock frequency with which the display data is transmitted to the second display region from the second transmitting circuit differ from each other.

11. A liquid crystal display device comprising:

a liquid crystal display panel;

a plurality of drive circuits which drive the liquid crystal display panel; and a control circuit coupled between an external device and the drive circuits and which is configured to supply digital display data from the external device to the drive circuits, wherein the liquid crystal display panel includes a first display region, a second display region and a third display region, the first display region, the second display region and the third display region differ from each other in the number of pixels, the control circuit includes:

a first transmitting path which outputs the display data to one or more of the drive circuits coupled to the first display region;

a second transmitting path which outputs the display data to one or more of the drive circuits coupled to the second display region; and a third transmitting path which outputs the display data to one or more of the drive circuits coupled to the third display region, wherein a number of pixels arranged in a row differs between the first display region and the second display region.

12. The liquid crystal display device according to claim 11, wherein the control circuit includes a first receiving path and a second receiving path to which the display data is inputted.

13. The liquid crystal display device according to claim 11, wherein the control circuit includes:

a first memory element which holds display data inputted from the first receiving path;

a second memory element which holds display data inputted from the first receiving path and the second receiving path; and a third memory element which holds display data inputted from the second receiving path.

14. The liquid crystal display device according to claim 11, wherein the control circuit includes:

a first memory element which holds display data inputted from the first receiving path;

a second memory element which holds display data inputted from the first receiving path and the second receiving path;

a third memory element which holds display data inputted from the second receiving path;

a first transmitting circuit which outputs the display data held by the first memory element to the liquid crystal display panel;

a second transmitting circuit which outputs the display data held by the second memory element to the liquid crystal display panel; and a third transmitting circuit which outputs the display data held by the third memory element to the liquid crystal display panel.

15. The liquid crystal display device according to claim 11, wherein the control circuit includes:

a first memory element which holds display data inputted from the first receiving path;

a second memory element which holds display data inputted from the first receiving path and the second receiving path;

a third memory element which holds display data inputted from the second receiving path;

a first transmitting circuit which outputs the display data held by the first memory element to the liquid crystal display panel;

a second transmitting circuit which outputs the display data held by the second memory element to the liquid crystal display panel; and a third transmitting circuit which outputs the display data held by the third memory element to the liquid crystal display panel, and a transmitting clock frequency of the display data outputted from the first transmitting circuit and a transmitting clock frequency of the display data outputted from the second transmitting circuit differ from each other.

16. The liquid crystal display device according to claim 11, wherein a clock frequency with which the display data is transmitted to the first display region from the first transmitting circuit and a clock frequency with which the display data is transmitted to the second display region from the second transmitting circuit differ from each other.

* * * * *